US005640863A

United States Patent [19]

Frolov

[11] Patent Number: 5,640,863

[45] Date of Patent: Jun. 24, 1997

[54] CLUTCH MECHANISM FOR DOOR LOCK SYSTEM

[75] Inventor: George Frolov, Farmington, Conn.

[73] Assignee: Harrow Products, Inc., Grand Rapids, Mich.

[21] Appl. No.: 524,349

[22] Filed: Sep. 6, 1995

[51] Int. Cl.[6] ..... E05B 25/00

[52] U.S. Cl. ..... 70/283; 70/149; 70/277

[58] Field of Search ..... 70/277, 149, 283, 70/278, 279

[56] References Cited

U.S. PATENT DOCUMENTS

| | | | |
|---|---|---|---|
| 4,135,377 | 1/1979 | Kleefeldt et al. | 70/264 |
| 4,770,012 | 9/1988 | Johansson et al. | 70/278 |
| 4,802,353 | 2/1989 | Corder et al. | 70/277 |
| 4,820,330 | 4/1989 | Lin | 70/277 |
| 4,899,562 | 2/1990 | Gartner et al. | 70/277 |
| 4,995,248 | 2/1991 | Liu | 70/107 |
| 5,027,629 | 7/1991 | Liu | 70/277 |
| 5,136,870 | 8/1992 | Gartner et al. | 70/277 |
| 5,475,996 | 12/1995 | Chen | 70/279 |

*Primary Examiner*—Steven N. Meyers
*Assistant Examiner*—Donald J. Lecher
*Attorney, Agent, or Firm*—Chilton, Alix & Van Kirk

[57] ABSTRACT

A door lock system includes a clutch mechanism for a lockset and has particular applicability in conjunction with lever handles. Two coupling assemblies are selectively rotatably coupled by a coupling pin. One coupling assembly is rotatably coupled to the lockset actuator. The other coupling assembly is rotatably coupled to the exterior door handle. A drive assembly includes a motor which selectively controls the position of the coupling pin to provide for the locking and unlocking functions.

26 Claims, 10 Drawing Sheets

CLUTCH MECHANISM FOR DOOR LOCK SYSTEM

BACKGROUND OF THE INVENTION

This invention relates generally to security systems which are mounted to a door to provide a latching and locking function. More particularly, the present invention relates generally to lock devices which may be employed with entry control devices to control access through a door.

Locksets which incorporate a lockable latch and/or a dead bolt have long been incorporated into doors. A number of door mounted security systems which employ electronic input such as key pads, contact activatable chips, card readers and other electronic means have also been employed for use in conjunction with the mechanical latching and locking mechanisms.

The recent hardware trends and the Americans with Disabilities Act regulatory requirements for lever handles at both the exterior and interior sides of the door have made some conventional latch/lock set mechanisms vulnerable to mechanical failure. Application of an opening force to lever handles may result in significant larger moments being transferred to the internal mechanical components of the lock set than occurs with conventional door knobs. Consequently, the requirement that the lock system mechanical components be able to maintain their functional and structural integrity may be more difficult to achieve under the increased load conditions presented by lever handles. With the advent of the electronic access employed in conjunction with the conventional mechanical-type lockset, the susceptibility to mechanical breakdown may also be increased.

SUMMARY OF THE INVENTION

Briefly stated, the invention in a preferred form is a clutch mechanism for a door lock of a type having a lockset with a projectable and retractable lockable latch. The lockset has an actuator for operating the latch. A first coupling assembly operatively connects with the actuator. A second coupling assembly is responsive to rotatable motion applied to a lever handle or other hardware at the exterior side of the door. The clutch mechanism selectively engages the first and second coupling assemblies. The clutch mechanism includes a pin carried by the first coupling assembly in fixed rotatable relationship therewith. The pin selectively engages the second coupling assembly. An injector disposed in generally fixed rotatable relationship with the lockset forces the pin into engagement with the second coupling assembly. A drive assembly for driving the injector between first and second positions provides for selectively rotatably engaging the first and second coupling assemblies to selectively lock and unlock the latch from the exterior side.

The second coupling assembly includes a slot which receives the coupling pin. The coupling assemblies are rotatable about a first axis. The coupling pin is slidably displaceable between an engaged and a non-engaged position along a second axis which is generally orthogonal to the first axis. A spring biases the coupling pin to the non-engaged position. A shear friction force relationship acts to retain the coupling pin in the engaged position upon rotating the second coupling assembly. The injector comprises a spring loaded push pin.

The drive assembly comprises a motor and a drive link for axially displacing the push pin. The drive link comprises a drive screw and a drive lever displaceable by the screw. The push pin is connected to the drive lever. A drive link also includes a spring shaft. A spring returns the exterior coupling assembly to a null position upon rotation. A sensor, such as a microswitch, senses the null position of the exterior coupling assembly.

The lock system may include an entry control, such as a key pad, key operated switch, card reader or the like. The entry control generates an output in response to a valid input. The drive assembly is responsive to the output for selectively locking and unlocking the latch. A key operated override may be employed to override the drive assembly to unlock the door.

An object of the invention is provide a new and improved clutch mechanism for a door lock system.

Another object of the invention is to provide a new and improved clutch mechanism which is capable of efficient and reliable operation under the increased torque demands that may be applied to lever handle type actuators.

A further object of the invention is to provide a new and improved clutch mechanism which has less susceptibility to mechanical failure.

A further object of the invention is to provide a new and improved clutch mechanism which may be efficiently employed in conjunction with an electronic entry device.

Other objects and advantages of the invention will become apparent from the drawings and the specification.

DETAILED DESCRIPTION OF THE PREFERRED EMBODIMENT

Figure 1:
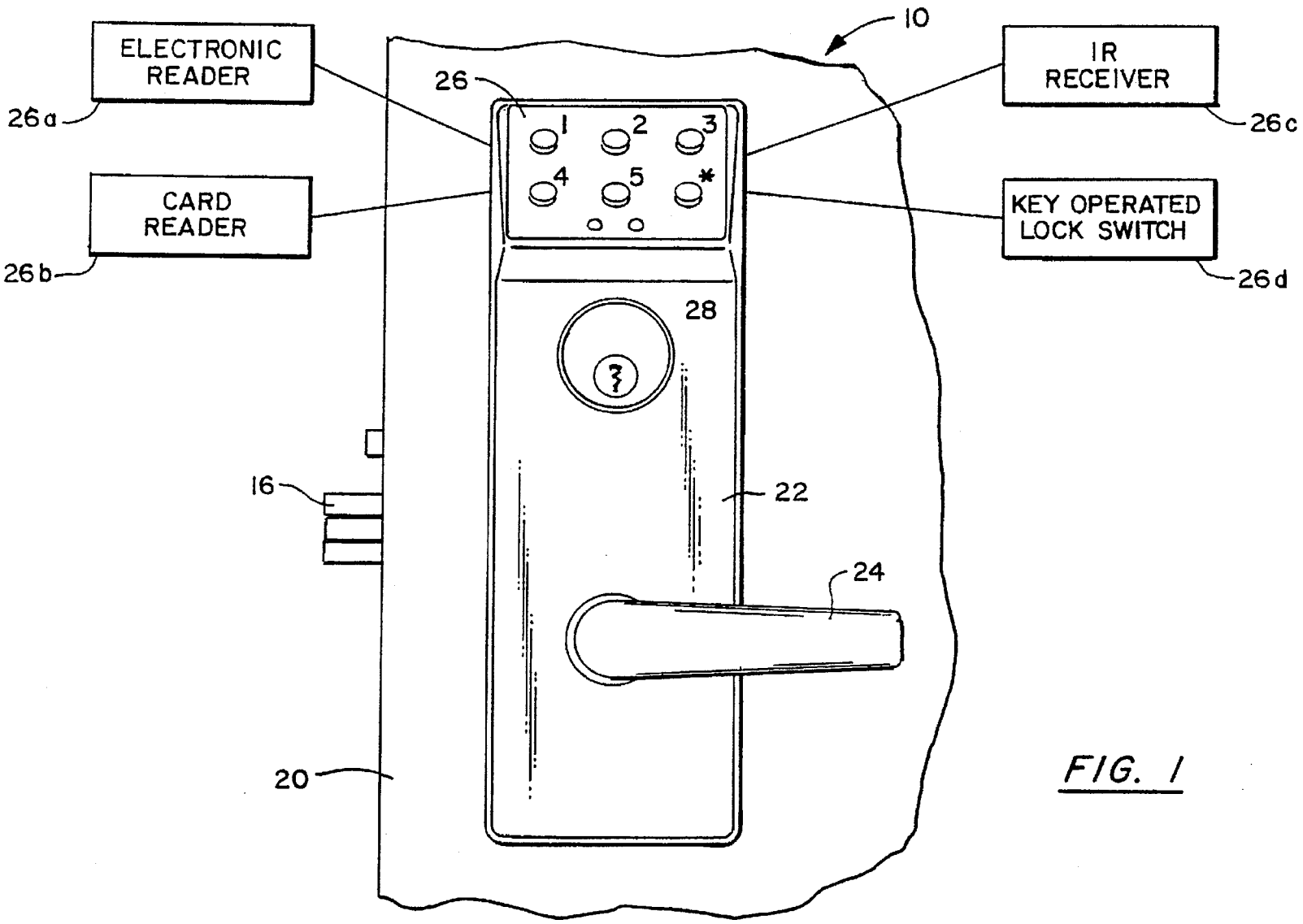
FIG. 1 is a fragmentary frontal view of a door having a door lock system incorporating a clutch mechanism in accordance with the invention, said lock system being illustrated in schematic to illustrate various possible features.

With reference to the drawings wherein like numerals represent like parts throughout the several figures, a door lock system 10 incorporates a clutch mechanism 12 in accordance with the present invention. The lock system includes a lockset 14 which may be a mortise type lockset or other type lockset. The lockset implements a latching function via latch 16 for latching and locking the door 20. Except for the modifications described herein, the lockset may be of any conventional form and function and is of a type wherein the outside operator or handle retracts the latch. The lockset is preferably operated by a cam or actuator arm which interacts with a spindle or spindles rotatably connectable with lever handles at each side of the door for withdrawing the latch.

In an illustrated embodiment, the door lock system employs a frontal escutcheon 22 which is mounted to the exterior side of the door 20. A lever handle 24, which is normally in a generally horizontal position, at the exterior of the door is operable to unlatch the door upon downward angular rotation.

Figure 3:
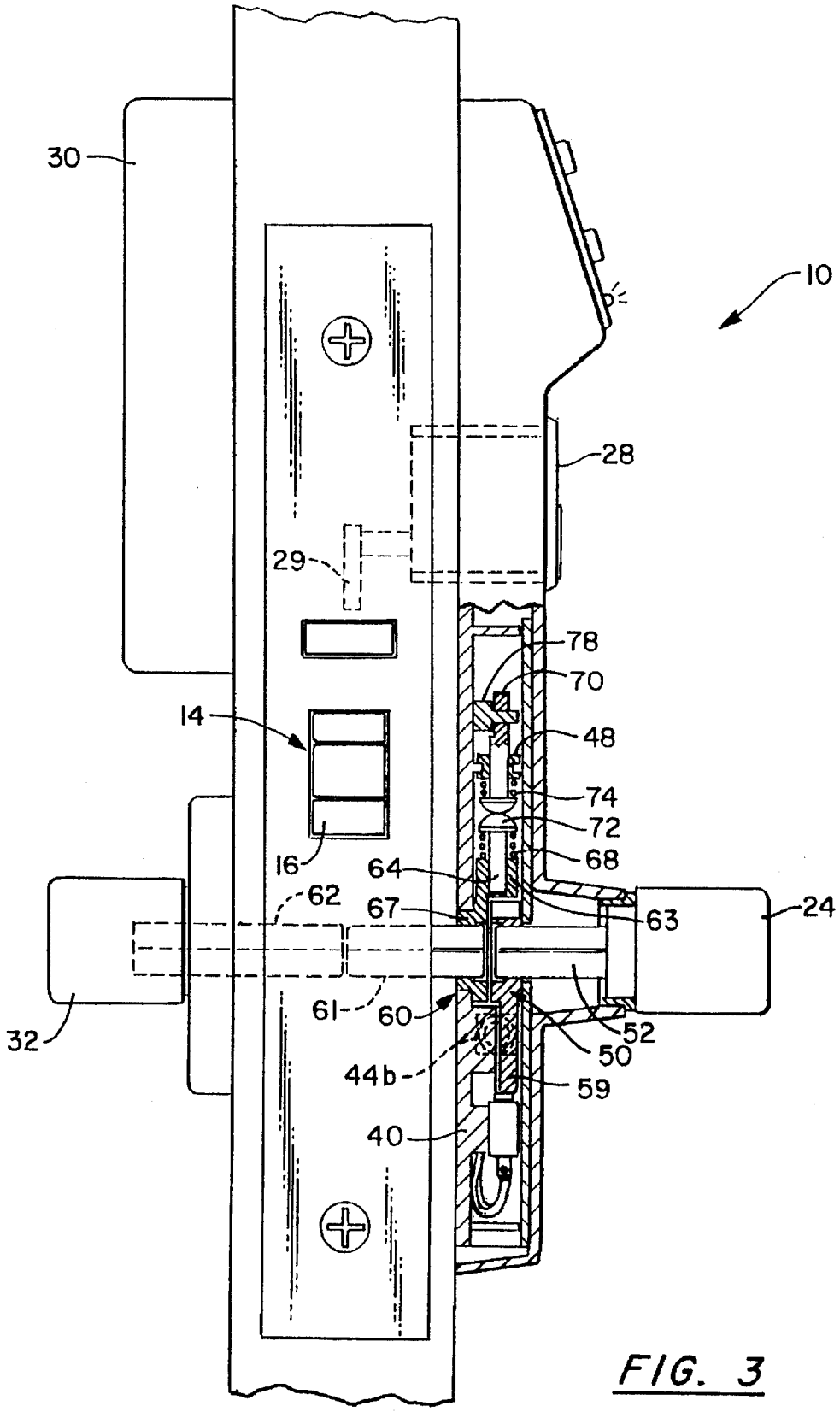
FIG. 3 is a side elevational view, partly broken away, partly in section and partly in phantom, of the door, door lock system and clutch mechanism of FIG. 1 viewed from the left thereof.

With additional reference to FIG. 3, the invention is described in the environment of a conventional door system wherein free egress through the door is permitted from the interior (left in FIG. 3) and the door is controllably secured from the exterior side (right in FIG. 3) by selectively transforming the lever handle 24 to an inoperative mode to effectively disable the lever handle. Access through the door may be obtained via an electronic access control device, which may be a keypad 26, a contact activatable electronic reader 26*a*, a card reader 26*b*, an IR receiver 26*c*, a cylindrical key operated lock switch 26*d* or other electronic device. A key-operated mortise lock 28 which operates a cam mechanism 29 interacting directly with the lockset in a conventional manner to implement a mechanical override function may also be employed.

A control module 30 and an inside lever handle 32 are mounted at the interior side of the door. The inside lever handle 32 also preferably normally assumes a horizontal position and is downwardly rotatable to permit egress through the door.

The clutch mechanism 12 functions to provide the mechanical engagement interface to allow for the proper latching, locking and unlocking functions for the lockset. The clutch mechanism 12 is particularly advantageous in conjunction with door systems which employ lever handles. The invention may also be employed in conjunction with door systems that employ knobs or other hardware.

The clutch mechanism 12 is interposed in the door latching system at the exterior side of the door between the lockset 14 and the lever handle 24. A frame 40 is mounted in fixed disposition at the front of the door and disposed under the escutcheon 22. The frame is configured for mounting various components of the clutch mechanism 12 as described below.

An operator coupling assembly 50 rotatably connects via a spindle 52 with the exterior lever handle 24 and is rotatable therewith. With reference to FIG. 3, which has a conventional form and function, actuator coupling assembly 60 connects via spindle 61 to the lockset actuator. An inner spindle 62 also connects the lockset actuator with the interior lever handle 32 and is rotatable with the lever handle for operating the lockset from the interior side of the door in a conventional fashion. The clutch assembly generally functions to provide selective rotatable engagement between the operator and actuator coupling assemblies as will be described below. The exterior lever handle 24, the interior lever handle 32, the operator coupling assembly 50 and the actuator coupling assembly 60 angularly pivot or rotate about a common axis.

Figure 2:
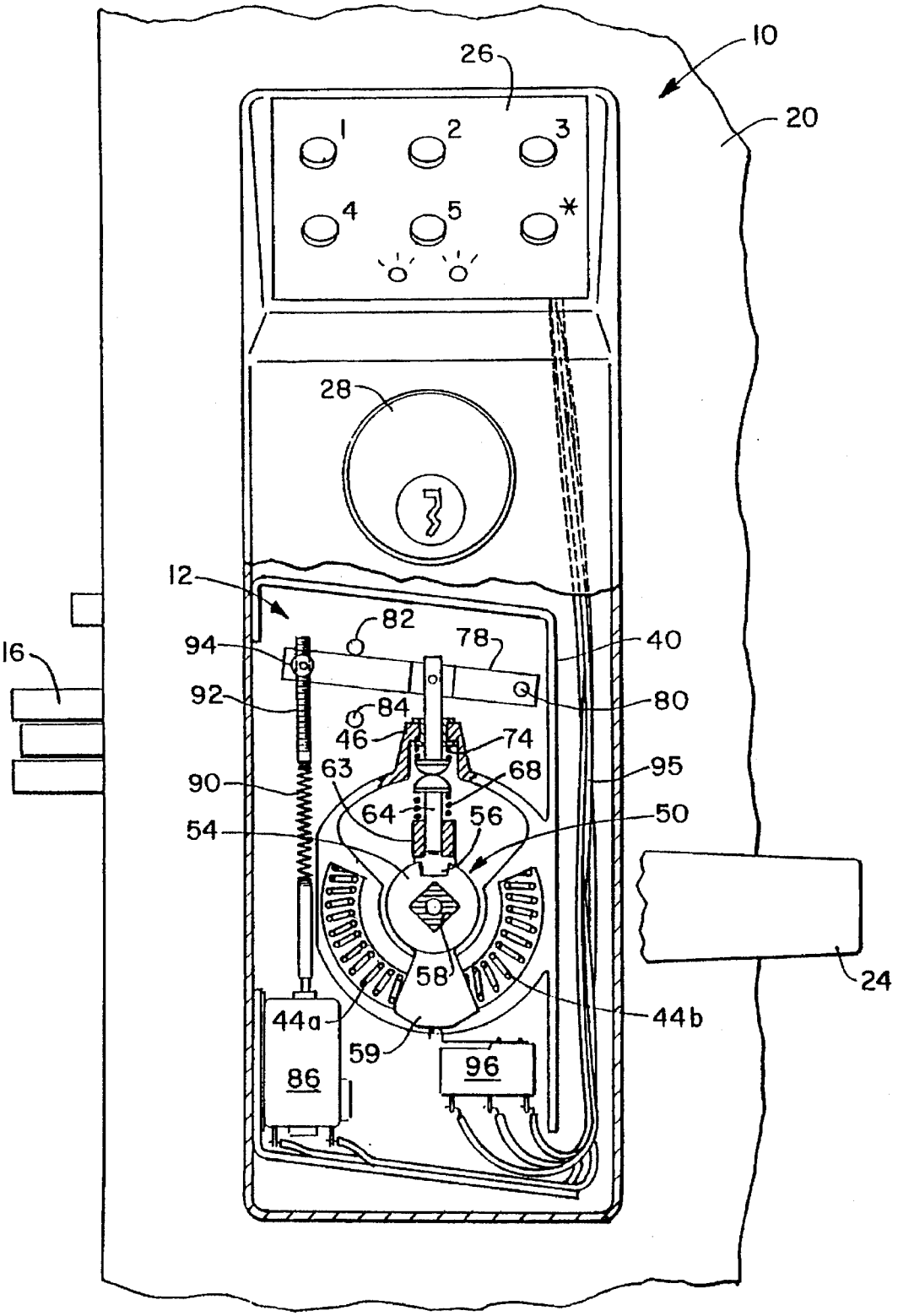
FIG. 2 is a frontal view, partly broken away, partly in section and partly in phantom, of the door, door lock system, and clutch mechanism of FIG. 1.

The operator coupling assembly 50 comprises a rotatable cylindrical coupler 54 which has a peripheral slot 56. The coupler includes a square axial opening 58 for receiving the outer spindle 52. A cam plate 59 extends from the coupler at a diametrically opposed position relative to the slot 54. The fixed frame forms a pair of arcuate recesses 42 for springs 44*a*, 44*b* which bear against the opposed portions of the cam plate 59 to bias the operator coupling assembly to the normal null position of lever handle 24 illustrated in FIGS. 2 and 5.

The frame 40 forms a yoke 46 which receives a sleeve 48. An injector push pin 70 which has a head 72 is slidably received in the sleeve for reciprocal axial motion therein. A spring 74 disposed between one end of the sleeve and the head biases the injector pin downwardly as viewed in FIGS. 2 and 3. The opposing end of the injector pin is pivotally connected to a drive lever 78 at an intermediate location thereof. The drive lever 78 pivots at one end about a pin 80 which is fixed to the frame. The angular displacement of the drive lever is limited by a pair of stops 82 and 84 which also define the extreme axial limits of the injector pin 70, and in particular head 72.

The actuator coupling assembly includes a rotatable plate 67 which integrally extends to form a bracket 63 for receiving the coupling pin 64. The distal end on the coupling pin 64 is dimensioned for reception in slot 56. The opposing end of the pin has a head 66. A spring 68 disposed between the head and the bracket upwardly biases the coupling pin. The bias force of spring 68 is substantially equal to the bias force of spring 74. The bracket and hence the coupling pin are rotatable in fixed relationship with the plate of the actuator coupling assembly which is rotatably coupled in a conventional manner with the lockset actuator.

Figure 4:
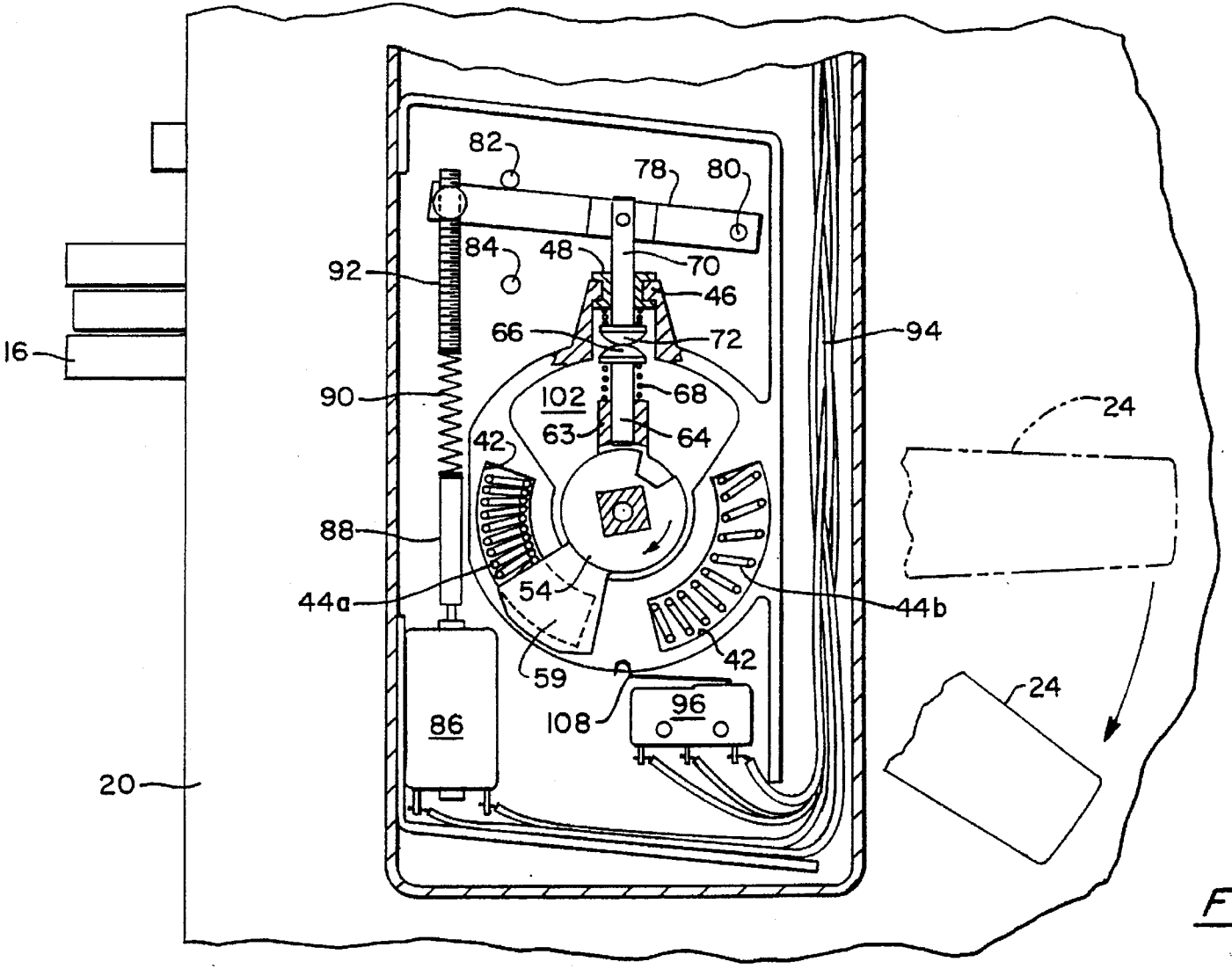
FIG. 4 is a fragmentary frontal view, partly broken away, partly in section and partly in schematic, of the door, door lock system and clutch mechanism of FIG. 1 illustrating a locked mode.

With reference to FIGS. 2 and 4–7, a bidirectional DC motor 86 is mounted to the frame. The motor drives a shaft 88 which connects via a spring shaft 90 with a drive screw 92. The drive screw threads to a drive nut 94 (FIG. 7) mounted to the drive lever 78 to angularly drive the drive lever about pin 80 and hence reciprocate the injector pin. The spring shaft 90 biases the drive lever against the stop 82 and thereby implements a normally locked configuration for the lock system, as illustrated in FIG. 4.

The entry control device 26 electrically connects via leads 94 and microswitch 96 with the DC motor 86 for operating the clutch mechanism. The operation of the clutch mechanism is sequentially illustrated in FIGS. 4 to 6 which progressively illustrate locked, unlocked/latched and unlocked/unlatched positions. In the position illustrated in FIG. 4, the entry control 26 is in a locked state and the operator coupling assembly 50 is in a free-wheeling state (rotatable in the central arrow direction) relative to the actuator coupling assembly 60. The exterior lever handle 24 is free to rotate in the direction of the outer FIG. 4 arrow. The coupling pin 64 is upwardly biased to engage the injector pin 70. For the upper position of the drive lever, the coupling pin 64 does not engage slot 56. The operator coupling assembly 50 is therefore in a limited free-wheeling state relative to the actuator coupling assembly 60. Any motion or torque applied to the outer lever handle simply results in a lost angular rotation of the operator coupling assembly, and the door remains in a locked condition from the exterior side. As best illustrated in FIG. 4, when the lever handle 24 is rotated, spring 44a compresses, and upon release of the handle, the spring 44a returns the operator coupling assembly 60 to the normal null position (FIGS. 1 and 2) wherein the slot 56 aligns with the end of the coupling pin 64. A substantial downward torque applied to the lever handle 24 is transferred via the cam plate 59 to solid fixed stops 41 (FIG. 7) incorporated into the frame 40 thereby preventing the torque from being transferred to the other vulnerable mechanical components of the door system.

Figure 5:
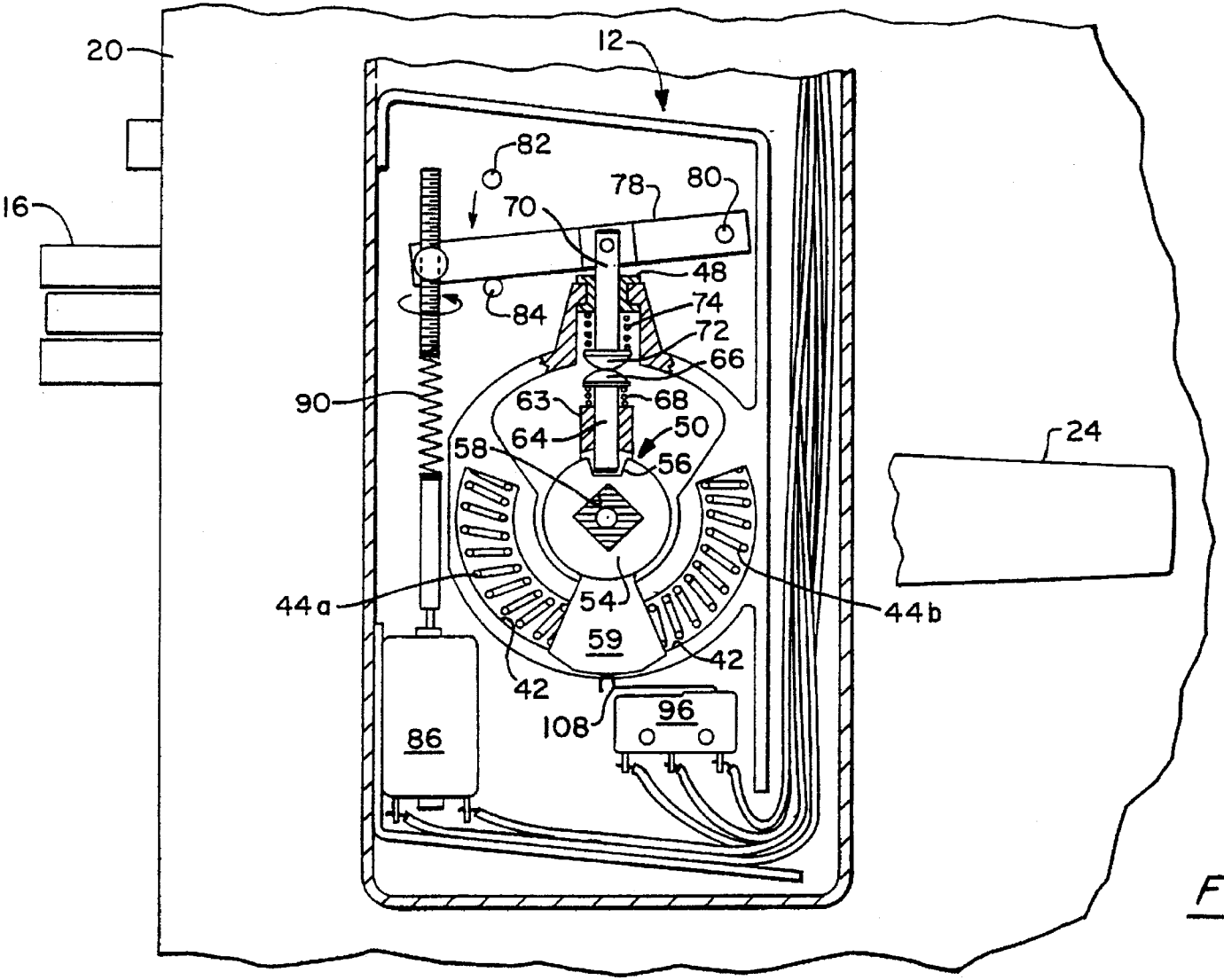
FIG. 5 is a fragmentary frontal view, partly broken away, partly in section and partly in schematic, of the door, door lock system and clutch mechanism of FIG. 1 illustrating an engaged mode prior to unlocking.

When the access control 26 is transformed to an unlocked state by entry of a valid code, card or key, the motor 86 energizes and drives the screw drive 92 to force the drive lever 78 and hence the injector pin 70 downwardly as indicated by the FIG. 5 arrows. The downward force of the injector pin overcomes the bias of spring 74. The pin heads 66 and 72 engage to force the distal end of the coupling pin into the slot 56 as illustrated by the arrows in FIG. 5. The motor 86 continues to drive shaft 88 until the drive lever engages the stop 84. The operator coupling assembly 50 and the actuator coupling assembly 60 are now rotatably coupled by pin 64 and hence the lever handle 24 is rotatably coupled to the lockset actuator.

Figure 6:
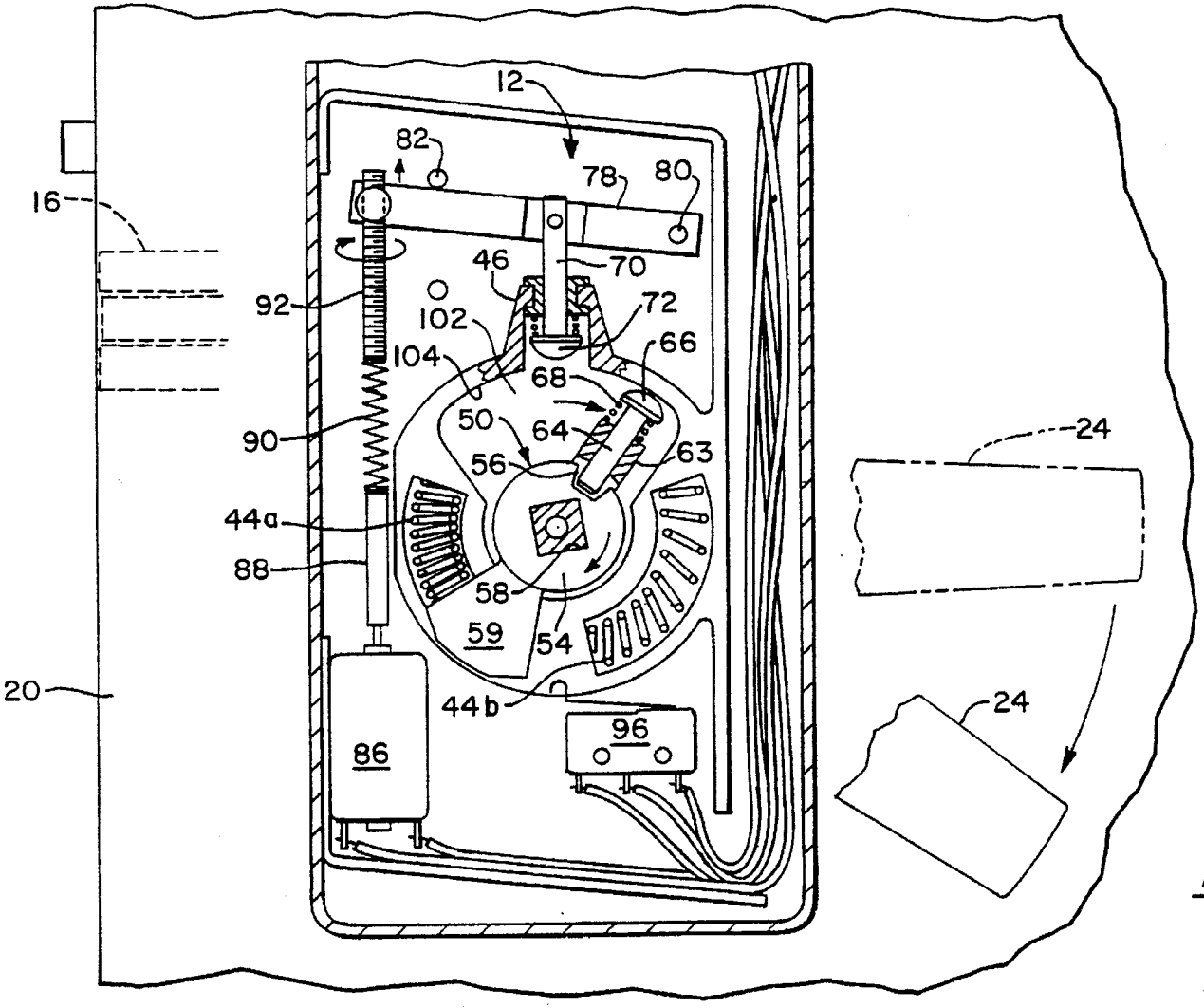
FIG. 6 is a fragmentary frontal view, partly broken away, partly in section and partly in schematic, of the door, door lock system and clutch mechanism of FIG. 1 illustrating an unlocked mode.

With reference to FIG. 6, as the exterior lever handle 24 is downwardly rotated, the coupling pin 64 engages in slot 56 of the outer coupling assembly and consequently the inner coupling assembly now rotates with the outer coupling assembly as indicated by the FIG. 6 arrows. The engagement interface between the heads 66 and 72 aligns with a shear rotation gap at the underside of the arcuate shoulder 104 to allow the coupling pin 64 to rotate away from alignment with injector pin 70. The frame defines a cavity 102 to permit rotation of the coupling pin 64 which is captured in the slot 56. The coupling engagement of the pin in the slot is maintained by the shear frictional force exerted by the side of the slot against the distal end of the coupling pin.

The cam 59 of the outer coupling assembly is correspondingly angularly displaced from a trigger arm 108 of the microswitch 96 as the operator coupling assembly 50 rotates. Consequently, the microswitch 96 is actuated to energize the motor in reverse to return the injector pin 70 to the initial upper position defined by the drive lever 78 engaging stop 82. In addition, upon the displacement of cam 59, the electronics may be temporarily shut off thereby saving power—especially for embodiments (not illustrated) which are battery powered.

The spring shaft 90 functions to self-center the drive lever 78 and self-compensate for any overtravel, undertravel or temporary jamming conditions. Because springs 68 and 74 are in a counterbalanced relationship, any overtravel or undertravel of the spring shaft results in corresponding compression or extension of the spring shaft so that the position of the drive lever will be self-compensated and effectively centered when the motor is reactivated.

The exterior lever handle 24 may be turned downwardly to withdraw the latch since the actuator which actuates the lock set rotates with the inner coupling assembly 60. When the coupling pin 64 is rotatably returned to the null position, the clutch mechanism assumes the FIG. 4 configuration.

Figure 7:
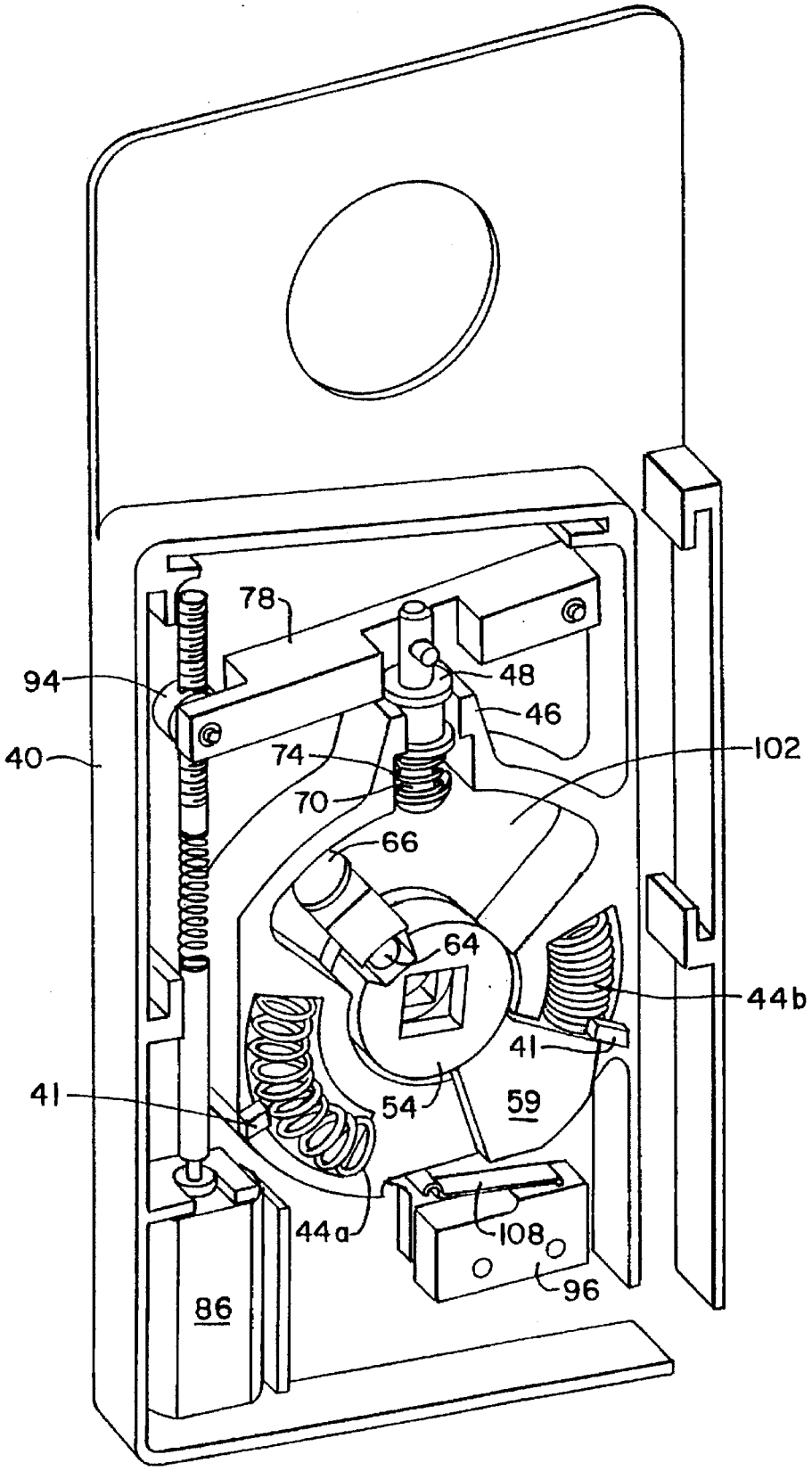
FIG. 7 is an interior perspective view, portions removed, of the clutch mechanism of FIG. 1, illustrating an unlocked mode for an opposite orientation of the lever handle.

Naturally, the clutch mechanism including, for example, the geometry of cavity 102, the position of springs 44*a*, 44*b* and the coupling assemblies rotational geometry, is adapted for use with either a right or a left hinged door as illustrated in FIG. 7.

Figure 12:
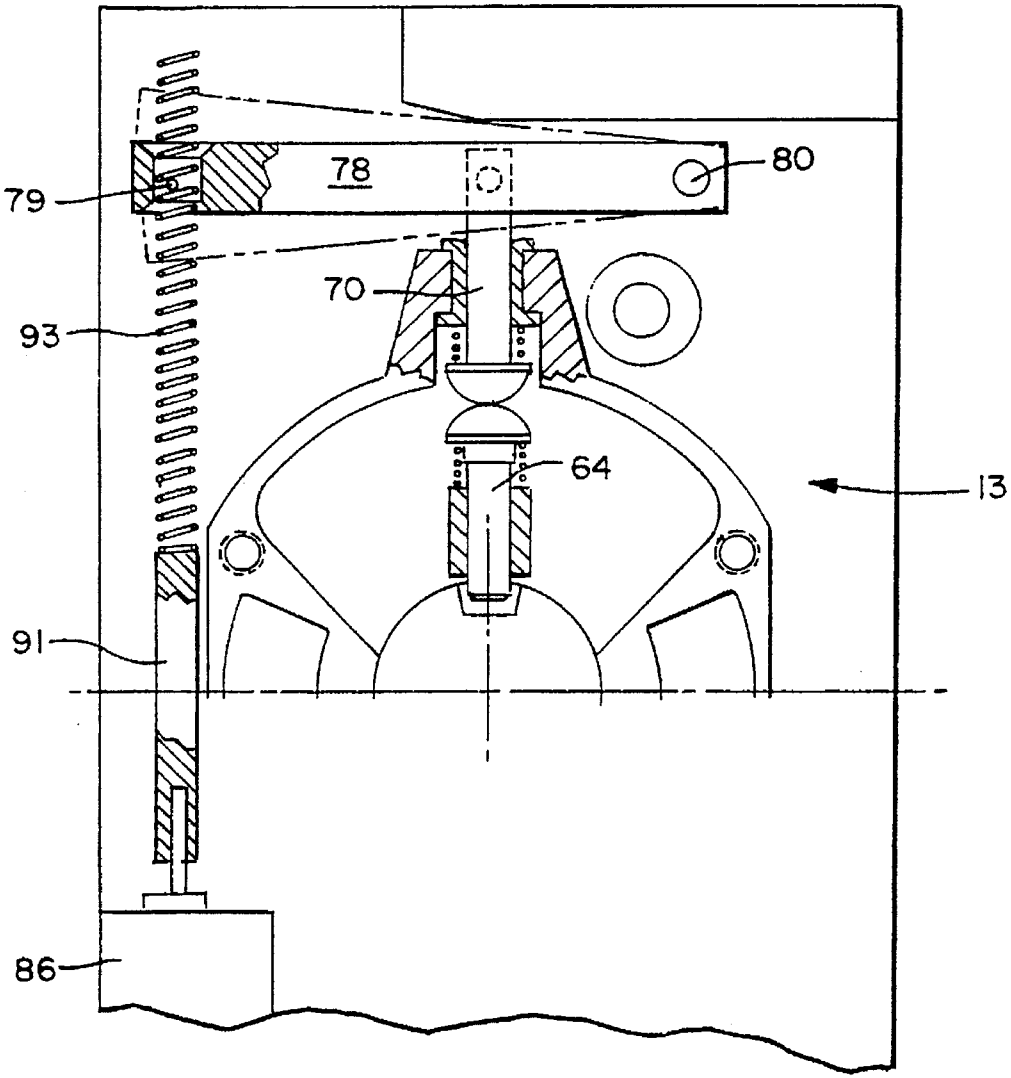
FIG. 12 is an enlarged fragmentary frontal view, partly broken away, partly in section and partly in phantom, of a door lock system incorporating a second embodiment of a clutch mechanism in accordance with the invention.

With reference to FIG. 12 which illustrates another embodiment of a clutch mechanism 13, the spring shaft 91 terminates in a helical spring 93. The spring is pinned to the drive lever 78 by a pin 79. This latter configuration is an alternative to the drive screw 92/drive nut 94 configuration previously described and the clutch mechanism otherwise functions in substantially the same manner as previously described for clutch mechanism 12.

Figure 9:
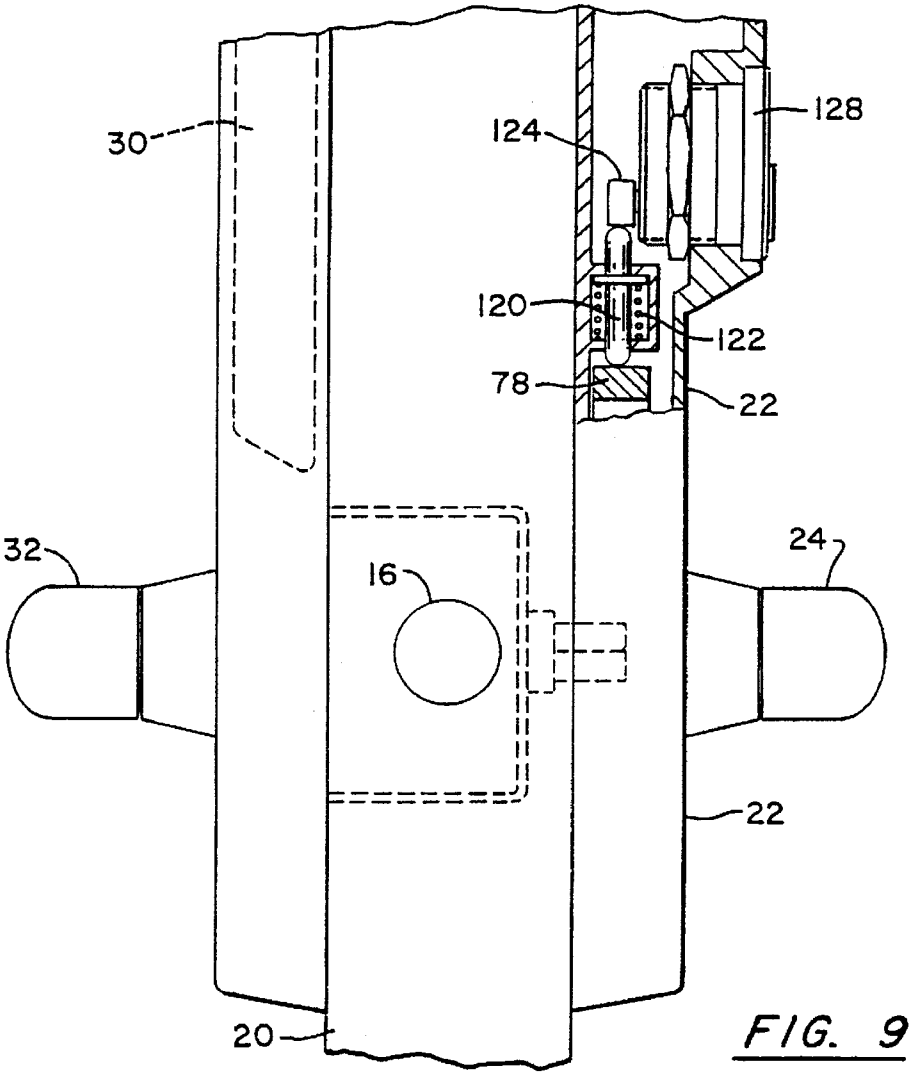
FIG. 9 is a side elevational view, partly broken away and partly in section, of the door lock system and clutch mechanism of FIG. 8 viewed from the left thereof and illustrated in conjunction with a portion of a door.
Figure 8:
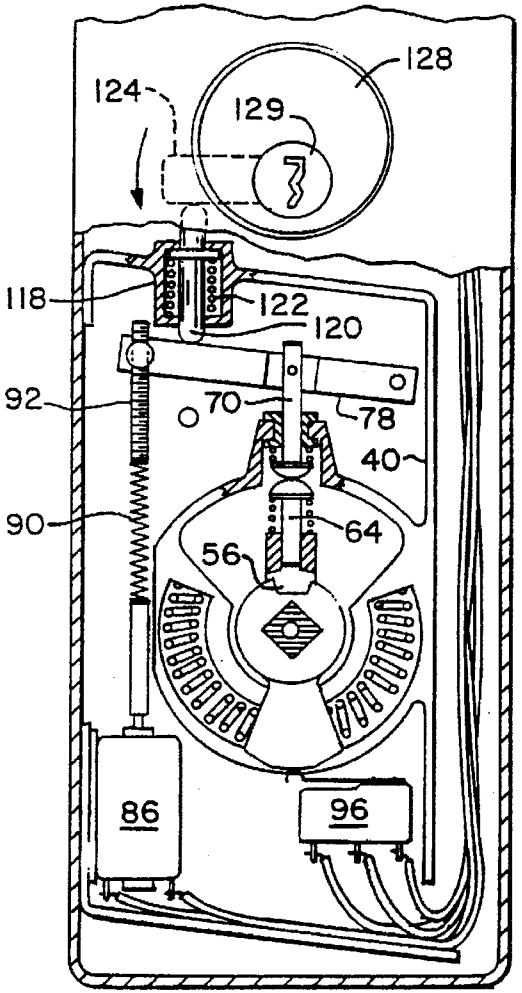
FIG. 8 is a fragmentary frontal view, partly broken away, partly in section and partly in phantom, of a door lock system incorporating a clutch mechanism in accordance with the invention and having electronic access control and a key override feature.

With reference to FIGS. 8 and 9, the key operated cam mechanism 128 functions as a mechanical override in the event that there is a malfunction in either the entry control device 26 or the drive components of the clutch mechanism. A sleeve 118 having a pair of partially closed ends is formed in the frame for receiving an override pin 120. The pin 120 has a distal end which is dimensioned for engagement against the drive lever 78. The override pin is biased by a spring 122 away from the drive lever 78. Upon insertion of a valid key (not illustrated) and rotation in the direction of the FIG. 8 arrow, the key plug 129 drives an arm 124. The arm 124 pivots to engage the top of the override pin 120. The pin 120 forces the drive lever 78 to inject the coupling pin 64 into the slot 56 and thus allow for unlocking of the door as previously described.

Figure 11:
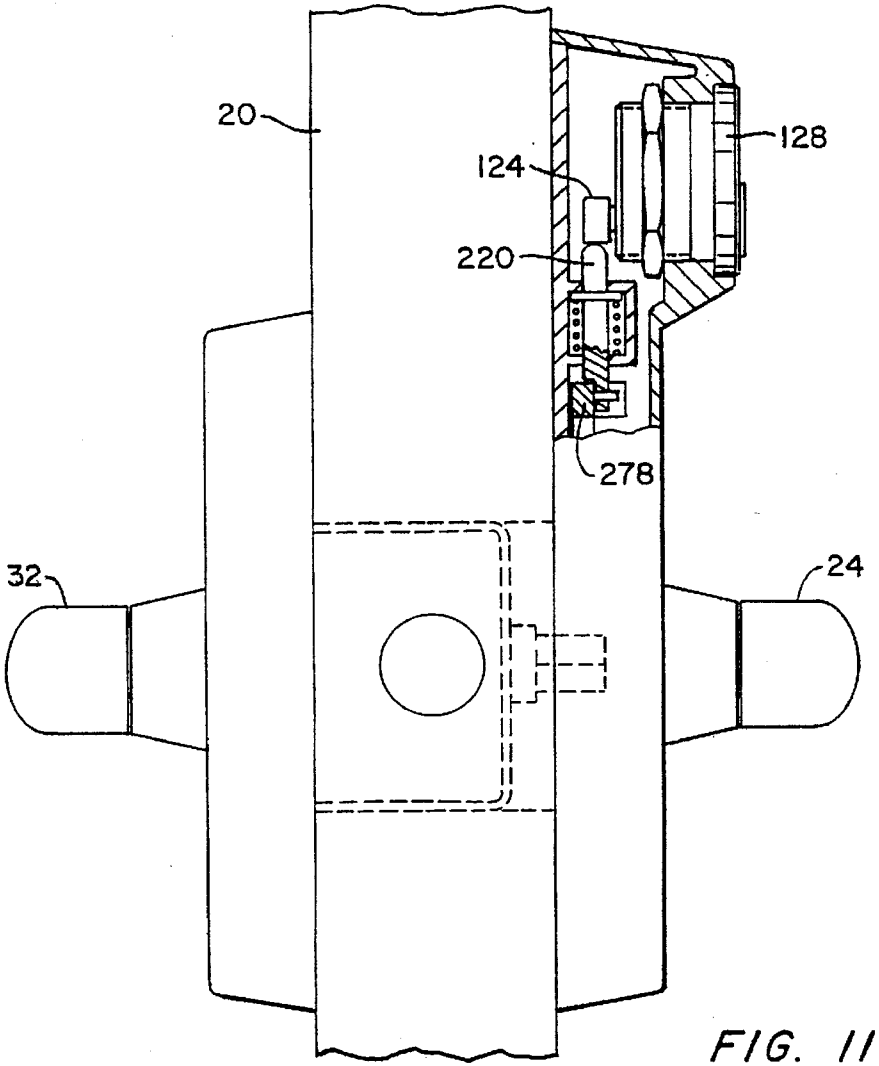
FIG. 11 is a side view, partly broken away and partly in section, of the door lock system and clutch mechanism of FIG. 10 illustrated in conjunction with a portion of a door.
Figure 10:
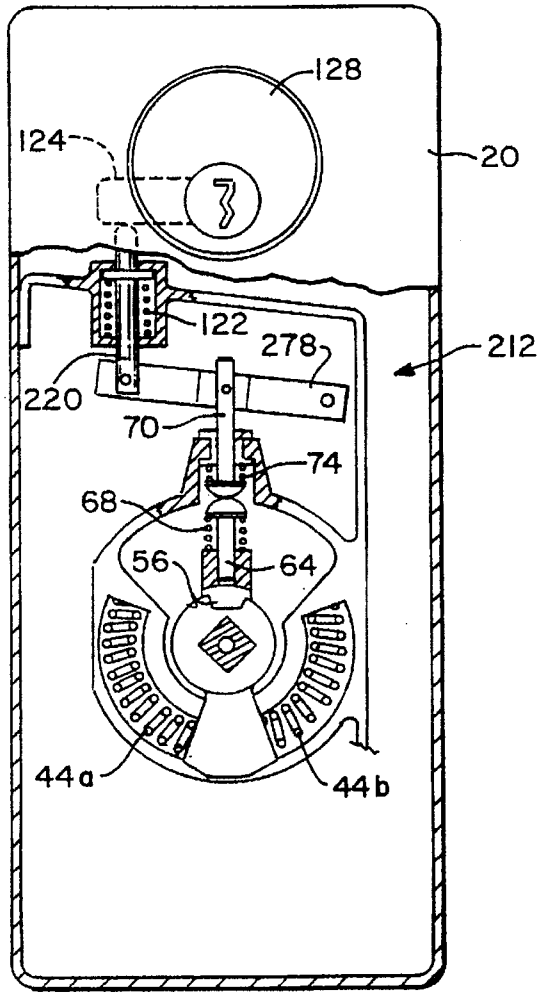
FIG. 10 is a frontal view, partly broken away, partly in section and partly in schematic, of a door lock system embodiment without electronic access control incorporating a clutch mechanism in accordance with the present invention.

With reference to FIGS. 10 and 11, a mechanically driven clutch mechanism for a mechanical lock system is designated by the numeral 212. The drive lever 278 is pivotally connected to the override pin 220. The cam mechanism 128 upon reception and rotation of a valid key pivots the arm 124 to engage the top of the pin 220 to thereby downwardly displace the lever arm 278. The push pin 70 forces the coupling pin 64 into engagement in the slot 56. Consequently, the operator and actuator coupling assemblies will thus be rotatably coupled. The motorized drive train and electronic entry device are not required for this embodiment. A torque applied to the exterior lever handle 24 will rotate the actuator cam of the lock set to thereby unlatch the door. In the unlocked mode, the bias force relationship of the coupling pin spring 68, spring 74 and spring 122 is such that the pin 64 does not effectively engage in the slot. Thus, in the unlocked mode, the operator coupling assembly is in a free wheel state relative to the actuator coupling assembly and a downward force applied to the effectively disabled lever handle 24 will not unlock the door.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A clutch mechanism for a door having a lockset with a lockable latch and an actuator for operating said latch, said clutch mechanism comprising:

first coupling means for translating rotational motion to operate said actuator;

second coupling means comprising a rotatable assembly for selectively translating rotatable motion applied at one side of said door; and clutch means for selectively engaging said first and second coupling means, said clutch means comprising:

pin means carried by said first coupling means in fixed rotatable relationship therewith for selectively engaging said second coupling means;

injector means disposable in generally fixed rotational relationship with said door for forcing said pin means into engagement with said second coupling means; and drive means for driving said injector means between first and second positions to selectively rotatably engage said first coupling means and said second coupling means for selectively locking and unlocking said latch from said one side, said drive means having a powered state and an unpowered state, said drive means maintaining said latch in an unlocked condition in said unpowered state, said drive means comprising a motor and a drive link comprising a spring shaft drivable by said motor for axially displacing said injector means.

2. The clutch mechanism of claim 1 wherein said second coupling means comprises slot means for defining a slot for receiving said pin means.

3. The clutch mechanism of claim 2 wherein said pin means is retained in an engaged position by a shear force exerted between a distal portion of said pin means and a portion of said slot means upon rotating said rotatable assembly.

4. The clutch mechanism of claim 1 wherein said first and second coupling means are rotatable about a first axis and said pin means comprises a coupling pin slidably displaceable along a second axis which is generally orthogonal to said first axis between an engaged and a non-engaged position.

5. The clutch mechanism of claim 4 further comprising spring means for biasing said coupling pin to the non-engaged position.

6. The clutch mechanism of claim 1 wherein said injector means comprises a spring loaded push pin.

7. The clutch mechanism of claim 1 wherein said drive link comprises a drive screw and a drive lever displaceable by said screw and said injector means is connected to said drive lever.

8. The clutch mechanism of claim 7 wherein said drive screw threadably engages said drive lever, and said drive lever pivots to move said injector means.

9. The clutch mechanism of claim 1 wherein said second coupling means is angularly positionable at a null position and is rotatable from said null position, and further comprising return spring means for returning said second coupling means to said null position.

10. The clutch mechanism of claim 9 further comprising position means for sensing the null position of said second coupling means.

11. The clutch mechanism of claim 10 wherein said position means comprises a microswitch which is electrically connected to said drive means.

12. The clutch mechanism of claims 10 wherein said drive means comprises a bi-directional motor and said position means enables said motor to drive said injector means.

13. A lock system for a door comprising:

lockset means comprising a projectable and retractable lockable latch and an actuator for operating said latch;

entry control means for receiving an input and generating an output in response to a valid input;

first coupling means for translating rotational motion to said actuator;

second coupling means comprising a rotatable assembly for selectively translating rotatable motion;

clutch means for selectively engaging said first and second coupling means, said clutch means comprising:

pin means carried by said first coupling means in fixed rotatable relationship therewith for selectively engaging said second coupling means;

drive means responsive to said output for driving said pin means between first and second positions to selectively rotatably engage said first coupling means and said second coupling means for selectively locking and unlocking said latch, said drive means comprising a motor and a drive link comprising a spring shaft drivable by said motor.

14. The lock system of claim 13 wherein said second coupling means comprises slot means for defining a slot for receiving said pin means.

15. The lock system of claim 13 wherein said pin means comprises a sleeve and a coupling pin slidably displaceable in said sleeve between an engaged and a non-engaged position.

16. The lock system of claim 15 further comprising spring means for biasing said coupling pin to the non-engaged position.

17. The lock system of claim 13 wherein said drive means comprises a spring loaded injector.

18. The lock system of claim 17 wherein said drive means axially displaces said injector.

19. The lock system of claim 18 wherein said drive link means comprises a drive screw and a drive lever angularly displaceable by said screw and the position of said injector is controlled by the angular position of said drive lever.

20. The lock system of claim 13 wherein said second coupling means is positionable at a null position and is rotatable from said null position, and further comprising return spring means for returning said second coupling means to said null position.

21. The lock system of claim 20 further comprising position means for sensing the null position of said second coupling means.

22. The lock system of claim 21 wherein said position means enables said motor drive said injector.

23. The lock system of claim 13 further comprising override means for operating said drive means independently from said entry control means.

24. A lock system for a door comprising:

lockset means comprising a projectable and retractable lockable latch and an actuator for operating said latch;

first coupling means rotatable about a first axis for translating rotational motion to said actuator;

second coupling means comprising a handle and an assembly rotatable about said first axis; and clutch means for selectively engaging said first and second coupling means, said clutch means comprising:

pin means carried by one said coupling means in fixed rotatable relationship therewith;

slot means for defining a slot in said other coupling means for receiving said pin means;

drive means for selectively driving said pin means into said slot means for selectively locking and unlocking said latch, said drive means comprising a drive link and a motor, said drive link comprising a pivoting drive lever having first and second positions, a drive shaft comprising a spring shaft mounted to said motor for rotation thereby, said drive shaft threadably engaging said drive lever wherein rotation of said shaft moves said lever between said first and second positions to drive said pin to unlock said latch.

25. The lock system of claim 24 wherein said first coupling means is axially positioned between said lockset means and said handle.

26. The lock system of claim 24 further comprising stop means for stopping said drive lever at said first and second positions.

* * * * *